United States Patent [19]

Dietrich

[11] Patent Number: 4,563,052

[45] Date of Patent: Jan. 7, 1986

[54] HIGH-FREQUENCY-PROOF ROUND PLUG CONNECTOR

[75] Inventor: Bernhard Dietrich, Eichenau, Fed. Rep. of Germany

[73] Assignee: SDS Relais AG, Deisenhofen, Fed. Rep. of Germany

[21] Appl. No.: 419,833

[22] Filed: Sep. 20, 1982

[30] Foreign Application Priority Data

Sep. 18, 1981 [DE] Fed. Rep. of Germany ..... 3137261

[51] Int. Cl.[4] ..... H01R 13/54; H01R 13/06

[52] U.S. Cl. ..... 339/143 R; 339/89 M

[58] Field of Search ..... 339/89 R, 89 M, 90 R, 339/143 R, 89 L

[56] References Cited

U.S. PATENT DOCUMENTS

| | | | |
|---|---|---|---|
| 2,762,025 | 9/1956 | Melcher | 339/143 R |
| 3,521,222 | 7/1970 | Andrews | 339/143 R |
| 3,678,445 | 7/1972 | Brancaleone | 339/143 R |
| 4,106,839 | 8/1978 | Cooper | 339/143 R |

*Primary Examiner*—Z. R. Bilinsky
*Attorney, Agent, or Firm*—Murray Schaffer

[57] ABSTRACT

A metallic plug and socket are joined to each other by a bayonet locking device to define an interior space which contains the contacts and which is sealed against the intrusion of electromagnetic waves by an O-ring as well as by a resilient contactor ring between the metallic casings of the plug and the socket. The contactor ring consists of a comb-like slit spring strip having a cross-piece lies between the plug and a contact inset and has comb roots pointed toward the socket. The comb tines are turned in a direction away from each other and recessed into the interior wall of the plug. The diameter of the contactor ring is greater in the range of the ends of the comb tines than is the diameter of the forward end of the socket casing which is to be pushed into place. The contact insert is provided with flanges which press the turned comb roots of the contactor ring into a groove in the wall of the plug.

3 Claims, 3 Drawing Figures

HIGH-FREQUENCY-PROOF ROUND PLUG CONNECTOR

BACKGROUND OF THE INVENTION

The invention concerns a high frequency cable connector provided with means to render the same free of undue influence from external electromagnetic waves.

Cylindrical high frequency cable connectors of this type comprise a plug and socket, joined by cooperating bayonet means, having an annular contactor ring. While the contactor ring can also be conductive, its main purpose is to prevent the signal carried over the connector from being influenced by outside electromagnetic waves.

Such a connector is known from DE-ES No. 29 27 438, where the contactor ring consists of flat material either laid meander-fashion or appropriately stamped to lie in an exterior annular groove. The width of the annular groove is less than that of the contactor ring so that it has an end closure which affords it a resilient property in a radial direction. For cylindrical cable connectors of larger diameter this solution can be applied without difficulty. However, with round plug connectors of relatively small diameter this is not possible without overly costly production tecnology.

From the journal "Technische Rundschau", No. 36 and No. 43, 1975, another cable connector is known in which the contactor ring consists of a flat keep spring strip which is slit in the manner of a louvre, with the resulting lamellar flanges each being turned at approximately 45 degrees on their long axis from the strip plane. This contactor ring is set into an interior ring groove in the plug casing which overlaps the socket casing. As elaborated in the above cited source, flat keep springs of this type can scarcely be produced with a width less than approximately 5 mm. In addition, with a width of e.g. 5 mm. substantial forces for the spring warping of the lammelar flanges and with that substantial plugging and pulling forces are required for creating and disconnecting the corresponding plug connection.

SUMMARY OF THE INVENTION

The foregoing problems are solved by the present invention through the provision of a resilient shield-contactor ring formed of spring strip in the shape of a comb, having a crosspiece and a plurality of teeth. The contactor ring is set between the plug and socket with the comb roots pointing to the socket and the teeth turned in a direction away from the central axis of cable connector, so that their outer diameter is greater than the outer diameter of the socket which is inserted therein; the plug and socket being formed with suitable annular grooves for receiving the ring and teeth.

This solution has the advantage that the contactor ring is a relatively, simply formed, stamped part which can be manufactured in small dimensions and which can set into the plug casing by simple means and held there permanently with the insertion of the contact carrier and without additional measures.

Advantageous variants and further refinements of the cylindrical plug connector in accordance with the invention will be obvious from the following disclosure.

DESCRIPTION OF THE INVENTION

Figure 1:
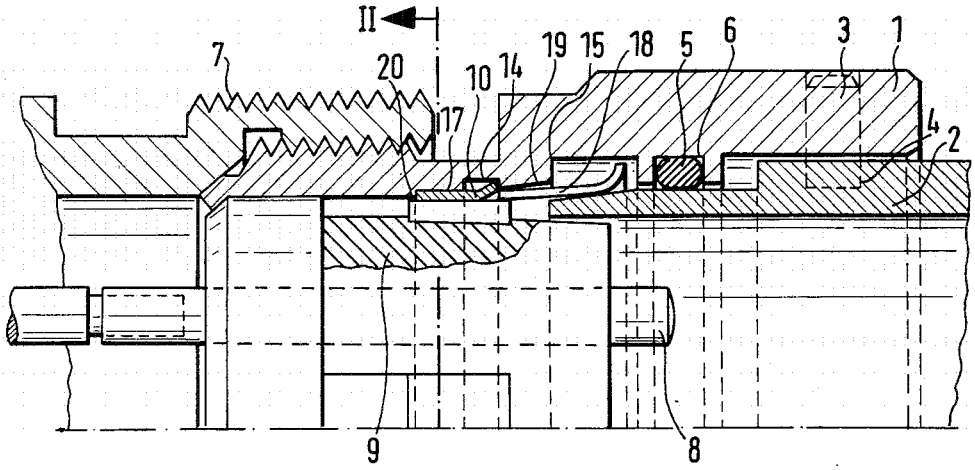
FIG. 1—a longitudinal cross section through a cylindrical connector exemplary of the present invention.

The round cable connector shown in FIG. 1 comprises a plug having a bascially hollow-cylindrical metallic casing 1 which overlaps in part an inserted hollow-cylindrical metallic socket 2 and which is connected with the latter by a bayonet catch having bayonet pins 3 arranged in the case 1 of the plug and bayonet tracks 4 arranged in the exterior surface of the socket 2. An O-ring 5 serves to seal the interior space of the cylindrical plug connector against moisture and foreign particles. The O-ring is seated in an annular groove 6 in the interior wall of the plug casing 1. An adaptor 7 is screwed to the cable end of the plug casing 1. The adaptor substantially surrounds the interior connection space of the plug within which the wires of the approaching cable are connected in conventional fashion not requiring further elaboration here, with the rearward ends of the contacts 8 embedded in a contact insert element 9 of insulating material.

Figure 3:
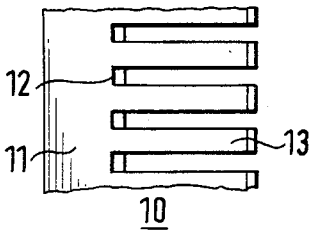

For high-frequency insulation and, if necessary, for current-conductive connection between the plug casing 1 and the socket 2, a shield-contactor ring 10 is used which as shown in FIG. 3 consists of a comb-like slit spring strip having a comb cross-piece 11, comb roots 12 and comb tines or teeth 13. The comb cross-piece 11 as shown in FIG. 1 lies between the plug casing 1 and the contact inset 9. The comb roots 12 and the comb tines 13 are shaped in such a way that their ends point away from the central axis of the cable connector so that their overall diameter is greater than the outer diameter of the socket 2, which is inserted therein. For accommodation of the comb roots 12, the plug casing 1 is provided on its inner wall with an annular groove 14 and for the accommodation of the comb tines 13 with an additional annular groove 15, whereby the flank of the ring groove 15 facing the ring groove 14 passes over a conical surface 19 which facilitates the feathering of the comb tines 13. For the same purpose the exterior surface of the forward end of the socket 2 is designed as a conical or tapered surface 18.

Figure 2:
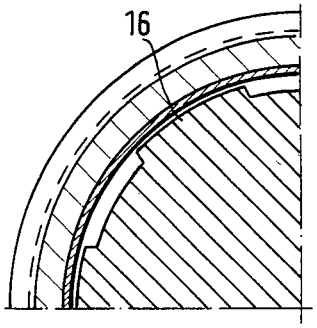
FIG. 2—a transverse section through the connector of FIG. 1 taken along line II—II, and FIG. 3—a top view of the contactor ring in developed projection.

The shield-contactor ring 10 is permanently held in place after the insertion of the contact inset 9 this contact inset 9 is provided on its exterior circmferential surface with flanges 16 (cd. FIG. 2) which press the comb roots into the annular groove provided for them. In addition, the contractor ring 10 is also secured against axial shifting since an additional flat annular groove 17 connects with the annular groove 14, the former holding the comb cross-pieces 11 of the shield-contactor ring 10 with a portion of its volume. Furthermore, the contact inset 9 is provided with an annular shoulder 20 facing the comb cross-piece 11. By these means the contact inset 9, after having been inserted in the plug casing 1 will on the one side hold the contactor ring 10 securely in place.

I claim:

1. A cable connector comprising a cylindrical plug and a cylindrical socket insertable into one end of said plug and being secured thereto by cooperating bayonnet locking means, an O-ring set between said plug and socket to seal said one end of said plug, a contact inset supporting a cable inserted into the other end of said plug and cooperativing with said plug to seal said other end, and a resilient contactor ring slidably arranged within the sealed interior of the plug about said contact inset, said contactor ring comprising a comb-like spring strip having a crosspiece lying between the contact inset and the plug, comb roots extending radially outward toward said plug and comb teeth extending axially toward said socket having comb and radially turned in a direction away from the central axis of the cable connector, the outer diameter of the contactor ring in the area of said comb teeth ends being greater than the exterior diameter of the socket when inserted into said plug, said plug having a pair of axially spaced annular grooves into which said comb root and comb teeth ends fit, said socket engaging said contactor ring to radially distend said comb roots and comb teeth to seat said contactor ring firmly in contact with said plug and socket.

2. The connector in accordance with claim 1, wherein the outer peripheral surface of the forward end of the socket has a slightly conical structure.

3. The connector in accordance with claim 2 wherein the inner peripheral surface of the plug is conically tapered to conform to said socket.

* * * * *